US006471118B1

(12) United States Patent
Chevalier

(10) Patent No.: US 6,471,118 B1
(45) Date of Patent: Oct. 29, 2002

(54) CARDBOARD CONTAINER OBTAINED BY FOLDING A STRIP FOR OBJECTS OF A VARIABLE HEIGHT

(76) Inventor: Pierre Andre Marc Chevalier, 31 Boulevard d'Auteuil, 92100 Boulogne, Hauts de Seine (FR)

( * ) Notice: Subject to any disclaimer, the term of this patent is extended or adjusted under 35 U.S.C. 154(b) by 0 days.

(21) Appl. No.: 09/646,866

(22) PCT Filed: Jan. 25, 2000

(86) PCT No.: PCT/FR00/00169

§ 371 (c)(1),
(2), (4) Date: Nov. 13, 2000

(87) PCT Pub. No.: WO00/43283

PCT Pub. Date: Jul. 27, 2000

(30) Foreign Application Priority Data

Jan. 25, 1999 (FR) ..... 99 00781

(51) Int. Cl.[7] ..... B65D 75/04
(52) U.S. Cl. ..... 229/103.3; 206/424; 229/125
(58) Field of Search ..... 229/103.2, 103.3, 229/125, 130, 122.23, 122.34; 206/424

(56) References Cited

U.S. PATENT DOCUMENTS

| | | | | | |
|---|---|---|---|---|---|
| 880,410 | A | * | 2/1908 | Singer | 229/125 |
| 2,072,753 | A | * | 3/1937 | Ikeda et al. | 229/125 |
| 3,038,463 | A | * | 6/1962 | Daymon | 229/125 |
| 3,524,580 | A | * | 8/1970 | Heyworth | 206/424 |
| 4,589,552 | A | * | 5/1986 | Chevalier | 229/103.2 |

FOREIGN PATENT DOCUMENTS

| | | | | | |
|---|---|---|---|---|---|
| DE | 2719288 | A1 | * | 11/1977 | 206/424 |
| FR | 2591998 | A1 | * | 6/1987 | 206/424 |
| FR | 2634458 | A1 | * | 1/1990 | 206/424 |
| FR | 2639327 | A1 | * | 5/1990 | |
| FR | 2680355 | A3 | * | 2/1993 | 229/103.3 |

* cited by examiner

*Primary Examiner*—Gary E. Elkins
(74) *Attorney, Agent, or Firm*—Young & Thompson

(57) ABSTRACT

A container made of cardboard or a similar material is designed as a packaging for objects such as books, records and other solid objects. The container is formed by a cut flank that is folded in order to define panels that include a base for receiving objects, side leaves that are folded back above objects that are disposed on the base, two small cross surfaces and a closing flap. The cut flank is made from a planar blank that is formed from two parallel rectangular parts having two terminating cross edges and two longitudinal edges. One part is held against the other using a lip in the shape of an isosceles triangle. One side of the triangle is cut and the other side and the base are formed by a fold line. The fold line with the base is located at a longitudinal edge that is common to both parts, over a short longitudinal distance adjacent to a single panel. The first of the two rectangular parts has an end panel that has a defined triangular flap in the contour of the second part. The length of the second part is such that the two cross edges thereof are substantially offset in relation to the cross edges of the first part. The second part is superposed in front of the first part to form a T.

15 Claims, 9 Drawing Sheets

CARDBOARD CONTAINER OBTAINED BY FOLDING A STRIP FOR OBJECTS OF A VARIABLE HEIGHT

BACKGROUND OF THE INVENTION

There are already known different ways of making cardboard containers, particularly in corrugated cardboard, which are formed from a panel cut out and scored and which, after transportation and storage flat, are set up at a variable height as a function of the thickness of the objects to be packaged.

These containers are often provided with a longacting adhesive when they are adapted to be used manually, the closure of the container about the objects being obtained by stripping the adhesive then applying to it a tongue provided with the adhesive on the panel located facing it.

In another version, the container must be formed by means of a machine which performs the operation automatically no matter what the final height of the container containing the objects to be packaged.

The supply of such a machine poses problems whose difficulty arises from the fact that two successively set-up containers can have different heights according to the height of the objects that each contains.

It must be emphasized that this problem is not at all the more simple one of supplying a machine on the one hand with containers and on the other hand with objects all identical to each other, in which case all sorts of mechanisms could be used which operate repetitively and in the same way.

On the contrary, with containers comprising different objects, there appears a phase intermediate to filling of the container and its closure, which is that of handling it in a stable manner, between partial folding of the container before emplacement of the objects on the base, and until closure of the container.

SUMMARY OF THE INVENTION

The present invention permits providing a semi-automatic packaging thanks to the economical design of containers, permitting the use of prolonged effect adhesive or glue (particularly that known as "hot melt") by assuring their stability, thanks to which the assembly of container and objects can be subjected to displacements without separation and can be subjected to closure operations when perfectly positioned.

To this end, the invention has for its object a container of hardboard or similar material adapted for the packaging of objects such as books, discs and other solid objects, formed from a panel that can be folded transversely to form from a sheet that can be folded transversely to form the panels of which one is a base for the reception of objects, lateral flaps which are to be folded down from above against objects disposed on the base, two small transverse surfaces and a closure tongue, which sheet is constituted from a flat blank formed of two rectangular parallel portions having two transverse end edges and two longitudinal edges, and connected to each other by an isosceles triangular tongue of which one side is cut away whilst the other side and the base are each formed by a bend line, that of the base being at the longitudinal edge common to the two portions, over a short length, opposite a single panel, characterized in that the first of the two rectangular portions is an end panel which is connected to the triangular tongue formed in the contour of the second portion, which second portion has a length such that the two transverse end edges are substantially offset relative to those of the first portion, one in front of and the other behind said transverse edges of the first portion.

BRIEF DESCRIPTION OF THE DRAWINGS

The invention will be better understood from the following detailed description given with reference to the accompanying drawings. Of course, the description and the drawings are given only by way of indicative example and are not limiting.

DETAILED DESCRIPTION OF THE PREFERRED EMBODIMENTS

Figures 1, 2, 3, 4:
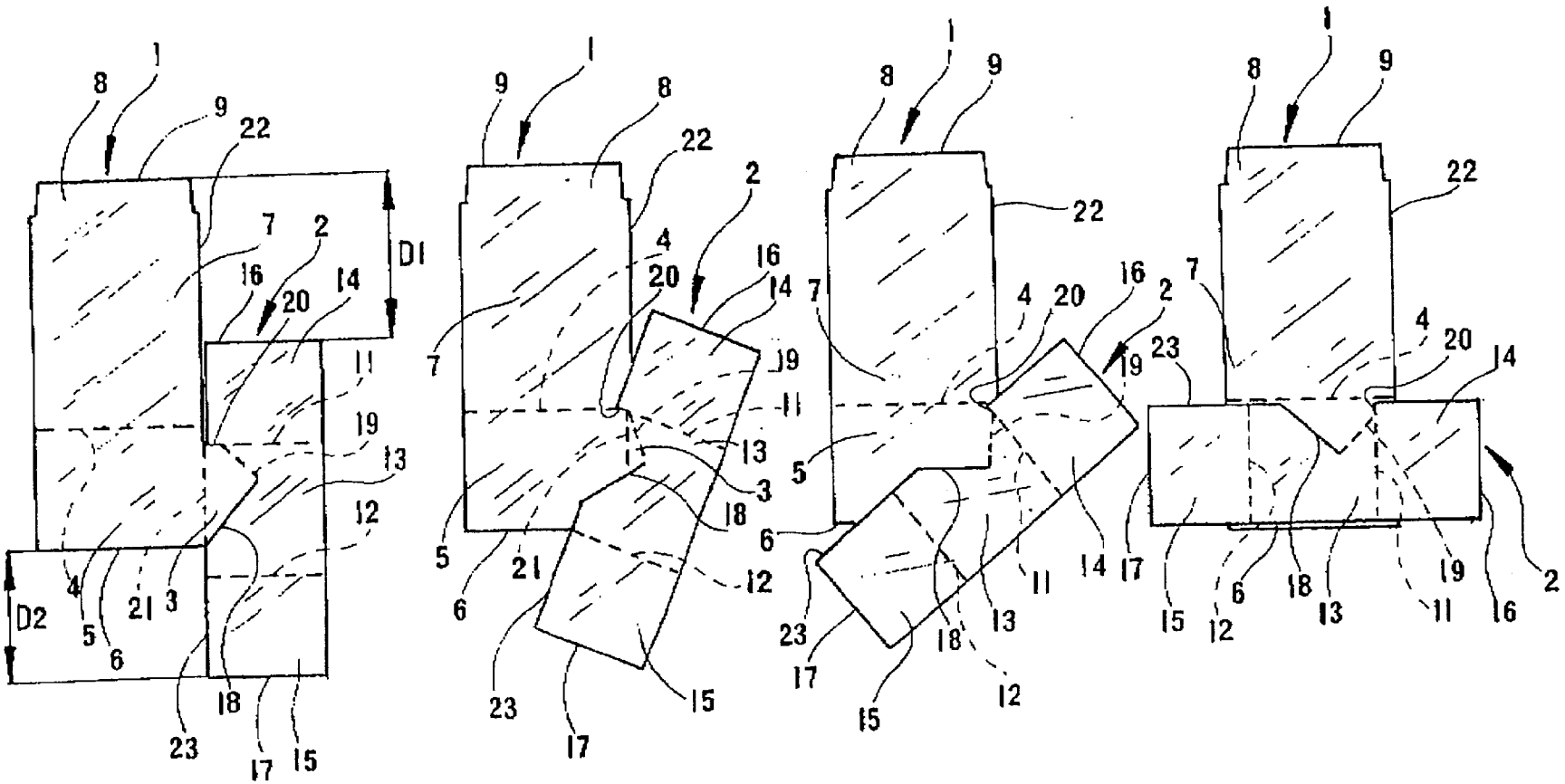
FIG. 1 is a schematic plan view of a sheet according to the invention, cut and scored to form a container.
FIGS. 2 to 4 are schematic plan views of the sheet of FIG. 1, in three phases characteristic of its bending to its position for receiving objects to be packaged.

Referring to FIGS. 1 to 10, there is seen a container according to the invention which in this case is obtained from a corrugated cardboard blank, cut out in a single piece in a plate and constituting, after cutting out and printing, a sheet formed of two parallel rectangular portions 1 and 2 connected to each other by a triangular tongue 3 formed in a contour of the rectangular portion 2.

The portion 1 has a transverse fold line 4 which determines on the one hand an end panel 5 extending to a free transverse edge 6 and on the other hand an intermediate panel 7 whose end forms a closure tongue 8 having a free transverse edge 9.

The portion 2 has two transverse fold lines 11 and 12 which define between them a central region 13 and two end flaps 14 and 15 having respective free edges 16 and 17.

The triangular tongue 3 that joins the portions 1 and 2 is formed in the contour of the central region 13. One of the sides of the isosceles triangle is formed by a cutout line 18 whilst the other is a fold line 19 interrupted by a short slot 20 cut out from the end of the fold line 11, so that the triangular tongue 3 is truncated and the fold line 19 does not reach the base of the triangle. The base of the isosceles triangle is constituted by a longitudinal fold line 21 located in prolongation of the respective adjacent longitudinal edges 22 and 23 of the portions 1 and 2.

It will be seen that the transverse edges 9 and 6 of the portion 1 and the transverse edges 16 and 17 of the portion 2 are very substantially offset from each other. The edges 9 and 16 are spaced from each other by a distance D1; the edges 6 and 17 are spaced from each other by a distance D2 shorter than the distance D1.

Moreover, the edge 16 is located in front of edge 9, whilst the edge 17 is located behind the edge 6.

The central region 13 therefore is not even approximately facing the median panel 7 but facing the end panel 5, and even "lower" than it considering the direction of the drawing of FIG. 1.

Acting on the portion 2 to move it in the clockwise direction, above the plane of the portion 1, as is shown in FIGS. 2 to 4, the triangular tongue 3 bends along its edges 19 and 21 and lets the portion 2 pivot by 90°, such that at the end of the movement, this portion 2 extends transversely to the portion 1, the central region 13 being located on the end panel 5. There is thus provided a base adapted to receive the objects to be packaged and formed by the superposition of the end panel 5 and the central region 13.

Figures 5, 6, 7, 8, 9, 10:
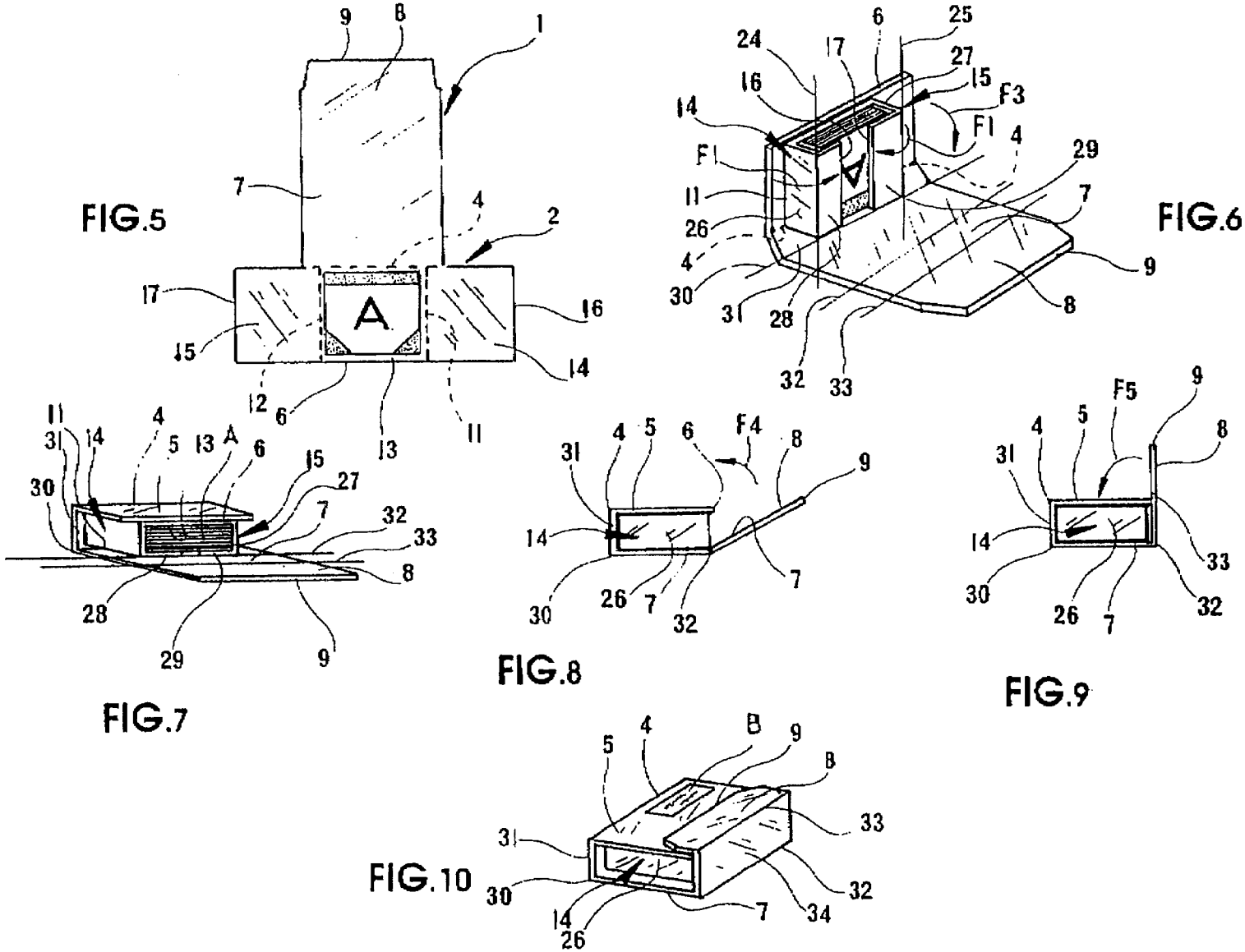
FIG. 5 is a schematic plan view analogous to that of FIG. 4, after positioning an object to be packaged.
FIG. 6 is a schematic perspective view showing a phase of packaging, starting with the FIG. 5 position.
FIG. 7 is a schematic elevational view showing the arrangement of the container of FIGS. 1 to 6 in a stable position intermediate between, on the one hand, the operations of setting up the container and of placing objects to be packaged in it, and on the other hand of closing the container.
FIGS. 8 and 9 are schematic views showing the finishing enclosure of the container, after the intermediate phase of FIG. 7.
FIG. 10 is a schematic perspective view of a container according to the invention, finished and ready to be transported.

In FIG. 5, there is shown a container which has been described and whose base has received an object, here a book A, whose weight is alone sufficient to maintain the portion 2 in a position transverse to the portion 1, despite the resilience of the cardboard container which tends to return the tongue 3 to its original position, the fold lines 19 and 21 having not been stressed to the point of breaking the fibers of the carton.

This use poses no problem of handling when the shaping of the container according to FIGS. 1 to 4 is done manually and the objects to be packaged are immediately adjacent the operator.

In the position of FIG. 5, the assembly of container-object is thus stable and it is easy to place several objects on each other and successively to complete the package.

When the base 5-13 has received all the desired objects, one or several, the flaps 14 and 15 are folded down toward each other according to the arrows F1, from above the objects disposed on the base and, according to the height of these objects, the flaps 14 and 15 will bend more or less farther from their free edges 16 and 17 along lines respectively 24 and 25, which creates, for each of them, a sidewall 26-27 and an upper flap 28-29 (FIG. 6) applied flat against the objects positioned on the base 5-13.

As is indicated above, this base 5-13 is formed by the superposition of the panel 5 and the central region 13 and, because of the natural elasticity of the corrugated cardboard, it is stable only because of the weight of the objects deposited on it.

For the same reason, the elasticity of the folded cardboard, the flaps 14 and 15 do not remain in the folded down position over the objects and if the operator releases them after having folded them down, they will spring back up.

The invention permits overcoming this drawback which, in the practice of packaging, is very grave because it complicates the handling, as the operator cannot release the flaps 14 and 15 for final closing of the container.

In this case, as the base 5-13 is disposed at the end of the portion 1, there remains an important length of cardboard beyond the base 5-13, of which the middle panel 7 forms a portion.

It is therefore possible, as is shown in FIG. 6, to pivot by 180°, in the direction of the arrow F3, the assembly formed by the base 5-13, book A and the folded down flaps 14 and 15, to apply the whole to the middle panel 7.

In the course of this pivoting, the cardboard sheet bends along the pre-existing fold line 4 and also along a transverse line 30 which automatically forms under the influence of the edges of the flaps 14 and 15 which force the cardboard to bend.

The emplacement of the line 30 relative to the transverse free edges 6 and 9 of the portion 1 is at random because it depends on the height of the objects placed on the flaps 14 and 15. The portion of the panel 7 located between the two transverse lines 4 and 30 thus constitutes a small transverse surface 31 of the container.

The length of the portion 1 is selected such that it remains from the middle panel 7, whose area is substantially equal to that of the base 5-13 (in reality, this area is equal to that of the area of the end panel 5 which is greater than the central region 13 because, in this case, there have been created protective edges) namely prolonged by a length of cardboard sufficient to form the container with a maximum height of the packaged objects, as will now be described.

At the end of this pivoting, the container is in the arrangement of FIG. 7 and it will be seen that the book A rests on the flaps 28 and 29 which, because of this weight, can no longer straighten out by the elasticity of the folded cardboard. The assembly is thus perfectly stable.

As a result, this arrangement can be prolonged as desired in the course of a packaging process, for example by a buffer supply between a phase of emplacing the object and a phase of closing the container.

This closing is carried out in the following manner:

the middle panel 7 is straightened along the arrow F4 (FIG. 8) by bending it along a transverse line 32 which automatically forms, under the influence of the edges of the flaps 14 and 15 opposite the preceding and which force the cardboard to bend.

After straightening (FIG. 9), the end of the portion 1 is bent according to the arrow F5, by bending it along a transverse line 33 which automatically forms, against the free edge 6, this edge constituting the closure tongue 8 whose length measured longitudinally relative to the greatest length of the original portion 1, is variable according to the objects packaged, this length being a minimum when the height of the objects is a maximum and, conversely, being maximum when the height of the objects is minimum.

The positioning of the lines 32 and 33 relative to the free transverse edge 9 is also at random because it depends also on the height of the packaged objects.

The cardboard portion located between the two transverse lines 32 and 33 constitutes the second small transverse surface 34 of the container, opposite the first one After folding down the tongue 8 (FIG. 10), the latter is fixed to the end panel 5, preferably by gluing.

This gluing can be carried out manually, particularly by actuating a glue distributor, or by means of a machine which, in addition to the glue properly so called, exerts pressure on the tongue 8 while the glue begins to act and moves the finished container toward an assembly and/or removal station.

The finished container has two large opposite surfaces 5 and 7, two small transverse surfaces 31 and 34 as well as two side surfaces 26 and 27 formed during folding down the flaps 14 and 15 from above the objects.

It will be noted that these sidewalls 26 and 27 are retracted relative to the longitudinal edges of the portion 1, because the spacing of the bend lines 11 and 12 is less than the width of the portion 1, thanks to which the overhanging portion of the portion 1 over all the periphery of the container and over the two sides forms external protective edges.

This arrangement is particularly advantageous but not required, and if it is preferred that the lateral surfaces be aligned with the edges of the portion 1, the triangular tongue 3 is smaller such that the lines 11 and 12 will be in alignment with the edges of the end panel 5 and no longer within its contour.

This finished container can receive a label B of any known type and is ready to be sent by post or messenger.

In the above description it has been explained that the central region 13 and the end panel 5 are maintained against each other by the weight of the objects placed on the base formed precisely by this superposition of these two elements (FIG. 5).

This supposes that the objects are disposed on the base 5-13 immediately after positioning the transverse portion 2 with the portion 1 (FIG. 4).

But it is also interesting to reach this position before placing objects on the base 5-13, particularly if the work stations corresponding to the separate packaging phases are separate and, as the case may be, whether an operator carries out the positioning crosswise of the portions 1 and 2, whilst another operator places objects on the base.

The invention permits tightening the central region 13 and the end panel 5 in a simple manner and does not impede ultimate operations of positioning objects enclosing the container.

Figures 11, 12, 13, 14:
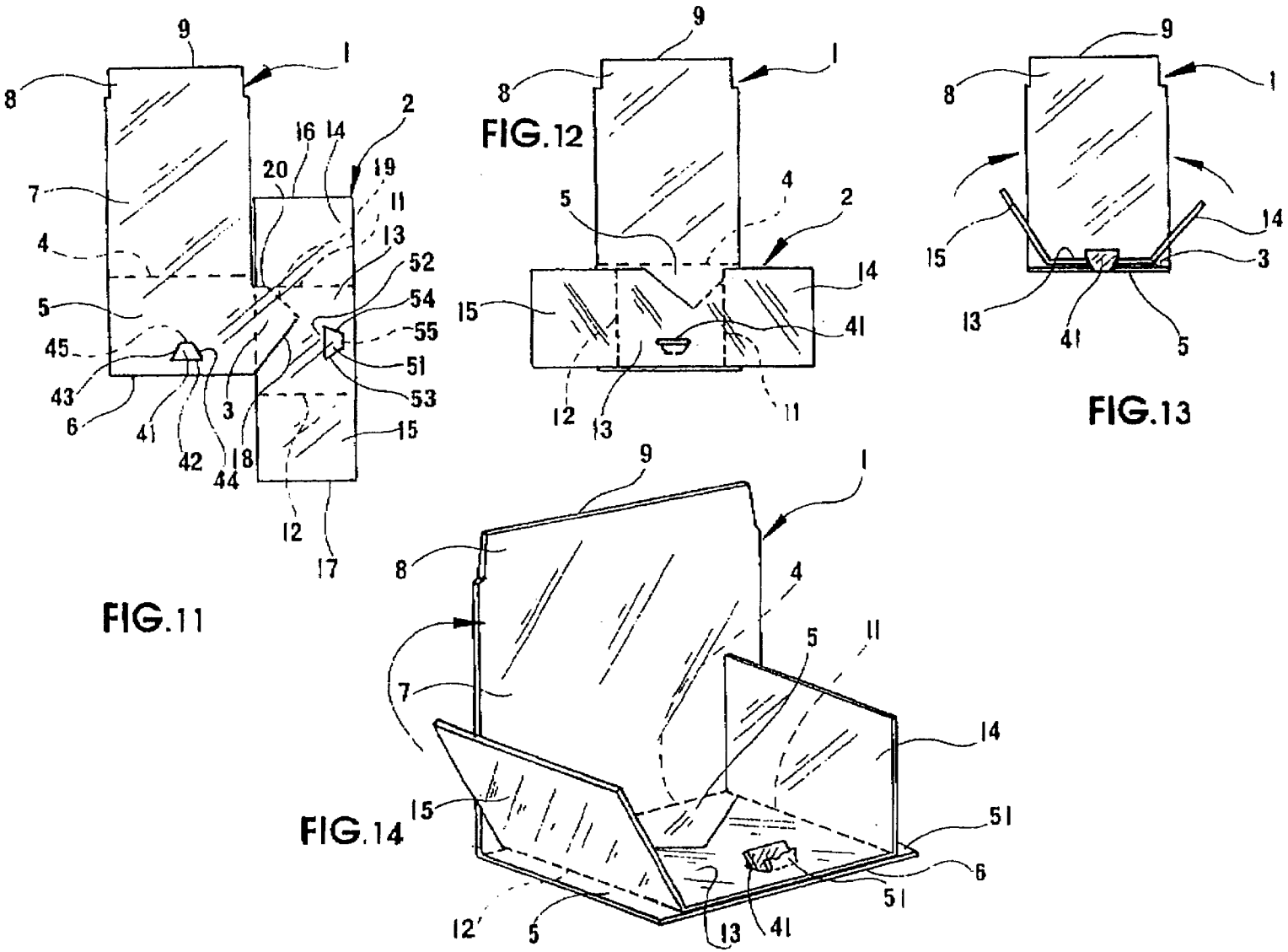
FIGS. 11 to 14 are schematic views which show a particular embodiment of the invention, according to which the container has means for holding it in a stable position of the base on which the objects to be packaged are to be placed.

FIG. 11 is equivalent to FIG. 1 and shows a sheet cut out and scored, the same reference numerals corresponding to the same elements as before.

The end panel has a tongue 41 in the form of a rectangular trapezoid whose large base is parallel and near the edge 6 and which is defined by three cutouts 42, 43 and 44 along the large base and the two sides. The small base of the trapezoid is a bend line 45 along which the tongue 41 can be bent out of its initial plane.

The central region 13 also has a trapezoidal tongue 51 defined by three cutouts 52, 53 and 54 along the large base and the two sides. The small base is a fold line along which the tongue 51 can be bent out of its initial plane but in this case it is the small base of the trapezoid which is near the longitudinal edge of the central region 13.

FIG. 12 corresponds to FIG. 4 and it will be seen that after pivoting the portion 2, the two tongues 41 and 51 face each other because both are respectively central relative to the end panel 5 and relative to the central region 13.

Moreover, the two tongues 41 and 51 are inverted, which is to say that the small base of one is aligned with the large base of the other, and vice versa.

When the portions 1 and 2 are in the crossing position according to FIG. 12, the operator acts with a finger either on the tongue 41 from below the end panel 5 or on the tongue 51 from above the central region 13. This done, he requires the tongue on which he presses (41 or 51) to push back the other (51 or 41) and to penetrate the trapezoidal opening freed by the bending of the pushed back tongue (51 or 41), such that the first, because of it shape, wedges, by slight deformation of the cardboard, in said opening which narrows.

This wedging thus causes the central region 13 to be applied against the end panel 5, ensuring tightening because it prevents the central region 13 from rising above the end panel 5, retained as it is by the tongue of one of these two elements wedged in the opening of the other.

In FIGS. 12 and 13, the tongue 41 is seen passing through the opening of the central region 13 and forming, because of this fact, a certain projection relative to the plane of the base to be dedicated to the objects to be packaged. But this prominence does not cause a drawback because upon the least pressure normal to the plane of the central region 13, the tongue 41 bends and returns to its initial position. There is then no longer a wedging, but this is unimportant because the objects disposed on the base 5-13 exert, because of their weight, a force sufficient correctly to maintain the central region 13 on the end panel 5.

Having positioned the objects to be packaged on the base 5-13, it remains only to fold down the flaps 14 and 15, as has been described above.

Referring now to FIGS. 15 to 19, there is seen a container which, as before, is adapted to send objects by post or messenger.

Such a container is particularly useful for businesses which send large numbers of packages: businesses that conduct correspondence sales or catalog sales, companies which only partially finish products, so that they produce semifinished articles (blanks, unrecorded compact discs, etc.) or which use a distribution organization having one or several storage centers distant from the manufacturing plant.

In all these cases in which a business carries out numerous mailings, it can be interesting to maintain a container in an intermediate position in which the constituent elements of the flat sheet are placed adjacent each other by one or several bends and maintained thus in a stable manner, such that the base will be freely accessible to deposit on it one or several objects, at one or several times.

To do this, the container according to the invention has means to assemble the emplaced elements adjacent each other.

As long as the container is not closed for shipping, the object or objects placed on the base remain accessible, particularly for control and verification. During closing the container, the adjacent elements must be separated so as to permit complete folding of the container.

This characteristic of the invention is very useful, for example, when the objects must be placed on the base several times, which is to say when the container must receive several objects one after the other.

These circumstances are encountered particularly when the containers are placed on a belt conveyor which moves among several loading stations at each of which an operator places selectively one or several objects to constitute a complete load, after which each container continues its movement to an individual closure station.

FIGS. 15 to 20 show an embodiment of the invention constituting a solution to this problem. According to this embodiment, the middle panel 7 has two openings 61 and 62 (FIG. 20) each formed by three respective incisions 63, 64 and 65–66, 67 and 68 extending along three sides of a rectangle whose fourth side is formed either by a bend line or by an incision. Thus, with the example shown here, the formation of the openings is not accomplished by withdrawing material but on the contrary by leaving for each of them a respective tongue 69 and 70 which, being constituted without any discontinuity by the cardboard forming the middle panel 7, preserves the integrity of the fibers of this cardboard. Each tongue 69-70 thus has the same natural rigidity as the cardboard, whilst any marking such as a fold line would give rise necessary to a weakening of this rigidity and, by breaking the fibers or even crushing the channels of the corrugated cardboard, would destroy the elasticity of the tongue 69-70 and would lower its ability to return automatically to its original position, whilst this property is necessary here, as will be seen from the description which follows.

Moreover, the longitudinal edge 23 of the portion 2 forms the respective edges 231 and 232 of the flaps 14 and 15 which, after the flaps have been straightened out of their plane to an orientation substantially perpendicular to the plane of the base 5-13, are located nearest the middle panel 7, itself straightened to be substantially perpendicular to the plane of the end panel 5. These edges 231 and 232 are each cut out with a respective notch 71 and 72 along a cutout having an edge 73-74 oblique to the corresponding edge 231-232 and a small return 75-76 which form a hook 77-78.

Figures 15, 16, 17, 18, 19, 20:
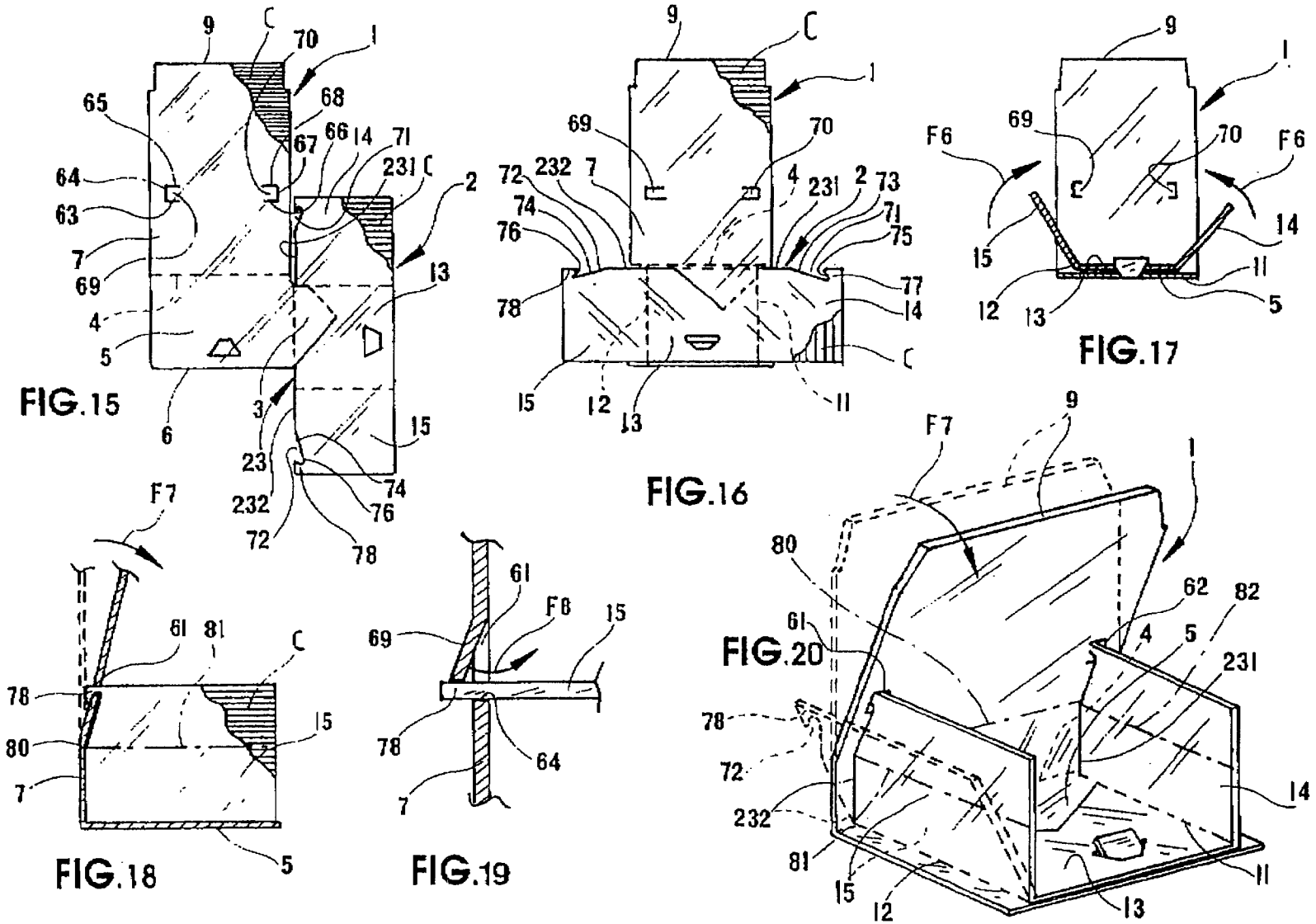
FIGS. 15 to 20 are schematic views of a container according to the invention whose sheet is in two portions and of which certain elements must be folded and placed adjacent each other and thus maintained temporarily, so as to facilitate the emplacement of objects to be packaged.
Figure 22:
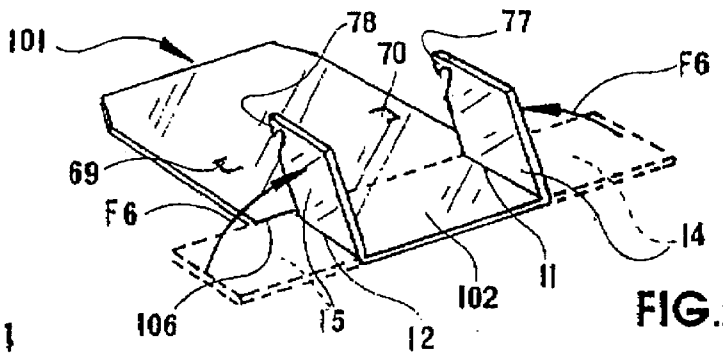
FIGS. 21 to 25 are schematic views of a container according to the invention whose sheet is of a single piece, which comprises means for holding in a temporary straightened position, and having protection for the corners of the finished container.

The combination of an opening 61-62 and a hook 77-78 forms means confining the flaps 14 and 15 to the middle panel 7 and are used in the following manner:

After the portion 2 has been disposed transversely to the portion 1 (FIG. 16), a portion of the central panel 7 is straightened by causing it to pivot about the line 4 and on the other hand the flaps 14 and 15 along the lines 11 and 12 (arrows F6, FIG. 17). When the three elements are each substantially perpendicular to the plane of the base 5-13, the flaps 14 and 15 are in parallel planes and both are perpendicular to the plane of the middle panel 7 and the hooks 77 and 78 of the flaps 14 and 15 are located facing the tongues 69 and 70 incised in the middle panel 7.

The upper portion of this panel 7 is then slightly inclined in the direction of the arrow F7, and when the tongues 69 and 70 encounter the hooks 77 and 78, the latter push the tongues 69 and 70 outside their original plane.

It is thus clear that the ability to sink in the hooks 77 and 78 is great because of their rigidity, which in turn is large because they act longitudinally, whilst the resistance of the tongues 69 and 70 is low, because they receive the force of the hooks 77 and 78 along their plane and moreover, this resistance arises only because of the small amount of material which remains along the fourth side of the rectangle whose three other sides are incised.

The hooks 77 and 78 pass through the entire thickness of the middle panel 7 by pushing back the tongues 69 and 70 to the extent that the panel 7 is inclined in the direction of arrow F7, which movement is rendered possible thanks to the notches 71 and 72.

To permit simply the movement of the panel 7 and the penetration of the hooks 77 and 78 into the openings 61 and 62, the necessary and sufficient condition is that there be a retraction of the material over the upper portion of the edges 231 and 232. As a result, the notches 71 and 72 could have any shape. But it is preferable to give them an edge 73-74 that is oblique according to the angle corresponding to that of the inclination of the panel 7 after engagement of the hooks 77 and 78, because in this way the panel 7 naturally bears against the edges 73 and 74 of the notches 71 and 72, the assembly of the container in this position being then very rigid and very stable (FIG. 20).

It can be considered that the oblique edges 73 and 74 can extend to the base of the flaps 14 and 15, the panel 7 then being inclined by simple pivoting along the fold line 4.

But the emplacement intended for the objects to be packaged (FIG. 20) would have a flat bottom 5-13, two vertical sidewalls 14 and 15 and an inclined bottom wall 7, which is not rational, given that the generally parallelepipedal objects which the container is adapted to receive, must be able to extend without impediment from the base 5-13 to a certain height and that it is preferable to give them a perfectly parallelepipedal positioning.

Thanks to the arrangements which have been described, the inclination of the panel 7 takes place automatically along a line 80 below which the panel 7 is perpendicular to the base 5-13 and which is inclined only above this line 80.

The level of this line 80 obviously depends on the emplacement of the point of meeting of the edges 231 and 232 with the edges 73 and 74 of the notches 71 and 72.

This placement is selected as a function of the dimensions of the container, such that the level of the line 80 will correspond to the levels of the lines 81 and 82 of the flaps 14 and 15 which mark the maximum height of the objects to be packaged. Thus, after emplacement of the objects to be packaged, the flaps 14 and 15 are folded down on each other and thus subdivide themselves into sidewalls for their unfolded-down position and in upper flaps for their ends applied to the objects.

These flaps should have a minimum length, without which the sidewalls will not be correctly maintained and the closed container could open and let the packaged objects escape.

The virtual lines 80, 81 and 82 thus correspond to the correct level of filling of the container and the invention permits visualizing perfectly this level because it is indicated by the line 80 along which the panel 7 is automatically folded and which is thus easily visible to the eye.

When external protective edges are not desired, the fold lines 11 and 12 of the flaps 14 and 15 are aligned with the edges of the portion 1 and hence in particular with the edges of the panel 7.

So that the hooks 77 and 78 can penetrate the openings 61 and 62, the flaps 14 and 15 are straightened out of their plane not more than 90° according to an angle a little more closed toward the center of the base 5-13, which is a less desirable arrangement than if the flaps were exactly perpendicular to the base 5-13, for the reasons indicated above, namely for ease of loading the objects. But that is nevertheless acceptable, the angle of closing of the flaps 14 and 15 remaining very small.

When the hooks 77 and 78 are completely engaged in the openings 61 and 62 (FIG. 18) they prevent the straightening of the panel 7 and they are effectively made in place thanks to the wedging action of the tongues 69 and 70 (FIG. 19) which are permanently urged back toward their original position, as indicated by the arrow F-8, and which apply the hooks 77 and 78 against the incised edge respectively 64 and 67.

When the sheet is cut out from a plate of corrugated cardboard, which the invention views as a preferred arrangement, the orientation of the channels C is selected such that they extend transversely to the portions 1 and 2 before crossing the portion 2 over the portion 1, as is shown in FIG. 15.

Thus, the tongues 69 and 70 are adapted to bow perpendicularly to the channels C (FIG. 15), which is to say by having a maximum resistance to bending.

Similarly, the hooks 77 and 78 are cut out to extend parallel to the channels C (FIG. 18), which are perpendicular to the sides 231 and 232 in which the notches 71 and 72 are cut out.

This optimum arrangement of the channels C both for the tongues 69 and 70 belonging to the portion 1 and for the hooks 77 and 78 belonging to the portion 2, results from the 90° crossing of these portions 1 and 2, as is seen in FIG. 16.

After having positioned the objects to be packaged in the volume limited by the base 5-13, the panel 7 and the flaps 14 and 15 (FIG. 20), the hooks 77 and 78 are disengaged, the flaps 14 and 15 are folded over the objects, then the panel 7 is folded from above over the whole, and the container is closed by fixing the end of the panel 7 below the end panel 5.

The hooks 77 and 78 are hidden by the panel 7 and give no risk of accidental hooking during handling the container.

The tongues 69 and 70 have returned to their original position in openings 61 and 62 in which they are wedged and which they completely close.

Referring now to FIGS. 21 to 25, there is seen a modification according to which the corrugated cardboard sheet is also cut out in a single piece, but without it being necessary to cross two separate pieces, as described above. The same elements bear the same reference numerals.

In this case, the sheet is cut out in a general T shape, and has a central portion 101 secured to a base 102 which is connected to the portion 101 by a fold line 103 at the ends of which are located cutout lines 104 and 105.

The base 102 is secured to the two lateral flaps 14 and 15 by fold lines 11 and 12. The notches 71 and 72 define hooks 77 and 78 to be located facing openings 61 and 62 cut out in the central portion 101.

In this case, there is therefore created from a single piece the portion 1 and the portion 2, without any superposition and without it being necessary to cause them to pivot relative to each other.

This is a more economical solution, because it requires a lesser quantity of cardboard, requires less room for storage and transport of the sheets, and permits immediately setting up the container, ready to receive objects to be packaged.

But if the finished container has a worse final form because its contour is interrupted, the eight corners of the finished container are well protected against shocks which can be experienced during handling of the container for its stacking and transport.

Figure 23:
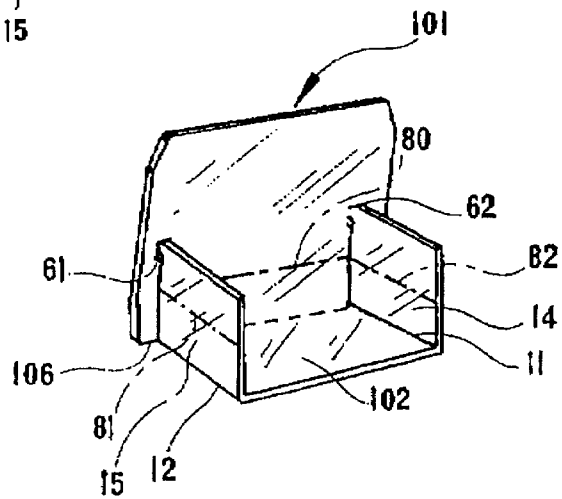

On the one hand, a central portion 101 is straightened up which pivots about the fold line 103, and on the other hand the flaps 14 and 15 are bent along arrows F6, so that they pivot along fold lines 11 and 12, such that there is obtained the arrangement of FIG. 23 in which the container is stable, because of the hooking of the flaps 14 and 15 to the central portion, by means of the hooks 77 and 78. The explanations already given above will not be repeated here.

Objects to be packaged can then be placed on the base 102, one or more according to the arrangement adopted for use of the containers according to the invention.

Figure 24:
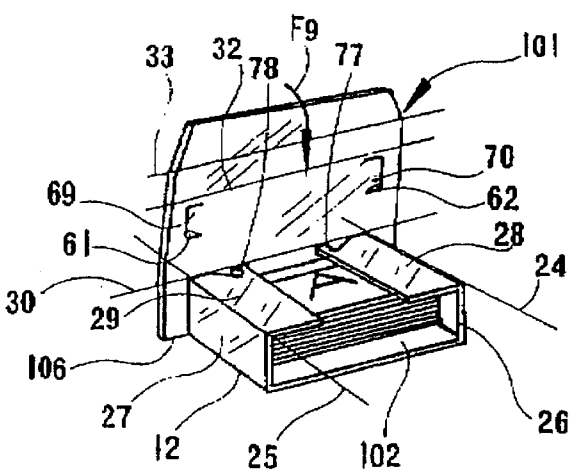

When these objects are in place, the flaps 14–15 are loosened from the portion 101, then they are folded down on the packaged objects (FIG. 24). This done, they fold transversely to themselves along lines 24 and 25 to form sidewalls 26 and 27 as well as flaps 28 and 29.

In accordance with what is explained above relative to the level lines 80, 81 and 82, the lines 24 and 25 coincide with the virtual lines 81 and 82 when the packaged objects extend over the maximum admissible height for a container of given dimensions.

The portion 101 is then folded down over the flaps 28 and 29, according to the arrow F9, this portion 101 bending along the pre-existing fold line 103 and also along a transverse line 30 which automatically forms under the influence of the edges 231 and 232 which force the cardboard to bend.

The position of the line 30 is random because it depends on the height of the objects which are located below the flaps 14 and 15, the region of the central portion 101 located between the two transverse lines 103 and 30 constitutes a small transverse surface 31 of the container.

The length of the central portion 101 is selected so as to be sufficient to close the container with a maximum height of the packaged objects.

After the portion 101 has been applied against the flaps 28 and 29, it is again bent, along the line 32 which automatically forms under the influence of the edges of the flaps 28 and 29, which force the cardboard to bend, then again along the line 33 such that the end of the portion 101, which constitutes a closure tongue, may be applied and fixed below the base 102, the zone of the central region 101 located between the two transverse lines 32 and 33 constitutes a second small transverse surface 34 of the container (FIG. 25) opposite the first one 31.

Figure 21:
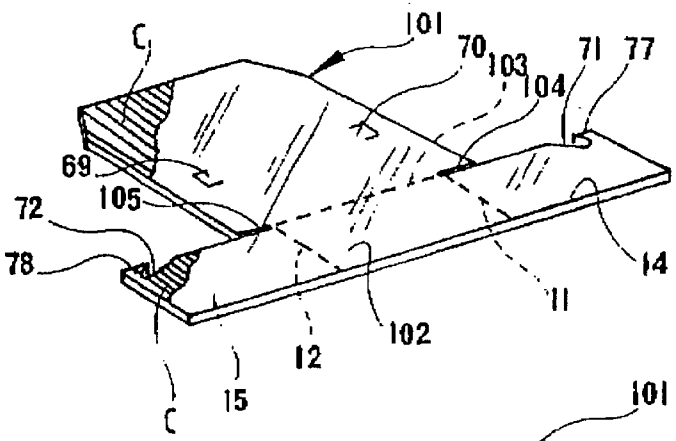

It will be seen in FIG. 21 that the fold lines 11 and 12 lead to the point of junction of the fold line 103 and the cutout lines 104 and 105. Because of this, when the side flaps 14 and 15 are straightened, they disengage from the edges of the cutout lines, of which only the edge 106 is visible in the drawings, the other being symmetric to the latter and being hidden in the drawing.

Thanks to this voluntary offset, the lateral edges 107 and 108 of the portion 101 extend beyond the small side faces 26 and 27 and constitute external protective edges.

Figure 25:
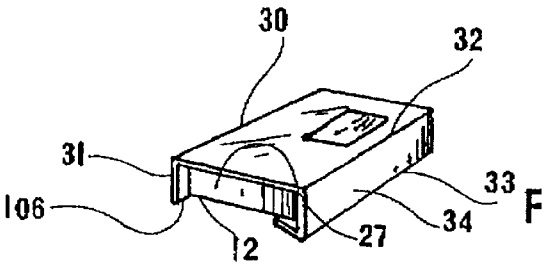

However, in this case, such an edge does not exist at the level of the base 102, as will be seen in FIG. 25. It could exist only if the height of the objects were a minimum, the return below the base 102 of the central portion 101 being prolonged over all the depth of the base 102.

Of course, there exist other solutions which permit obtaining a continuous protective edge of which an example will be described later.

With this simple and inexpensive embodiment, the channels C are evidently in the same direction for the portion 101 and for the flaps 14 and 15.

It can be selected to cut out the sheet according to one orientation or the other, but no matter what it is, it cannot be optimum both for the tongues 69 and 70 and for the hooks 77 and 78.

If, as shown, the channels C are longitudinal to the hooks 77 and 78, the tongues 69 and 70 will have less spring force. If the channels were perpendicular to those shown in the drawing, the tongues 69 and 70 would have strong fiber but the hooks 77 and 78 would be less rigid.

It falls accordingly to the practitioner to select the best solution as a function of the quality of the cardboard available and as a function of the practical characteristics of the use of the containers during packaging operations.

Tests have shown that for medium quality cardboard, the best solution is that shown in the drawing, namely the channels C being longitudinal to the hooks 77 and 78, which is to say perpendicular to the edges of the flaps 14 and 15 in which the notches 71 and 72 are cut out.

Referring now to FIGS. 26 to 30, there is seen an embodiment according to which the sheet is of a single rectangular piece having a central portion 111 secured to an end panel 112 by a transverse line formed in several segments: two lateral fold lines 113 and 114 and a central cutout line 115, interrupted by two small uncut segments 116 forming hinges.

Moreover, the end panel 112 has two longitudinal fold lines 117 and 118 defining two lateral margins 119 and 120 of which the wider is substantially equal to the length of the fold lines 113 and 114.

The free edges of the panel 112 are cut out to provide notches 71 and 72 defining the hooks 77 and 78, whilst the portion 111 is incised to present openings 61 and 62 as well as the tongues 69 and 70.

The panel 112 is cut longitudinally along a line 121 leaving two small segments 122 forming holding bridges, and has an opening 123.

Figures 26, 27, 28, 29, 30:
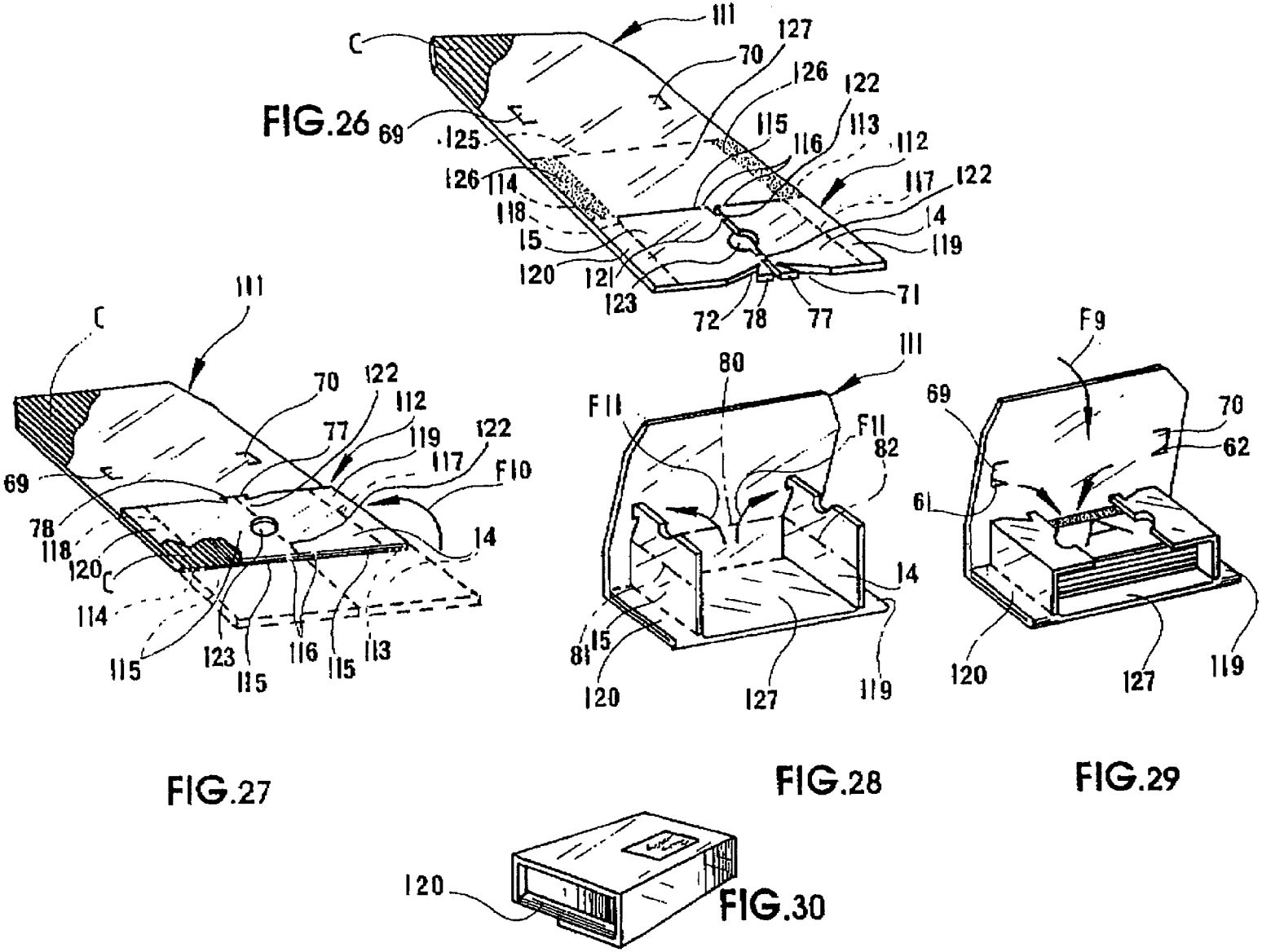
FIGS. 26 to 30 are schematic views of a container according to the invention, analogous to that of FIGS. 21 to 25 but more elaborated because of the eight corners being protected and in that other external protection edges are continuous over all the periphery of the side surfaces of the finished container.

During production of the sheet, after having cut out and marked fold lines as has been described above, the glue 126 is deposited in points or lines as those skilled in the art know how to do, on the side margins of the portion 111, between the fold lines 113, 114 and a transverse fold line 125, then there is folded down on the portion 101, in the direction of arrow F10, the end panel 112 which keeps a good connection thanks to the presence of the hinges 116 and the bridges 122, this portion 111 and this panel 112 thus being fixed to each other by the glue 126, along their lateral margins (FIG. 27). This embodiment then permits a use analogous to that which has been described with respect to FIGS. 21 to 25, except as to the direction in which the lateral flaps 14 and 15 are straightened up.

Thus, to straighten these latter, the operator engages a finger in the opening 123 and exerts a pull to raise the two flaps 14 and 15 which pivot about the fold lines 117 and 118 (arrows F11, FIG. 28) and if the bridges 122 have not first been torn, this pull suffices to break them and to free the two flaps.

The portion 111 is straightened up which pivots about the fold line 125, then the hooks 77 and 78 are engaged in the openings 61 and 62 to result in the stable position of FIG. 28.

The straightening of the flaps 14 and 15 has the effect of uncovering the end 127 of the portion 111 which constitutes the base for receiving objects to be packaged.

After emplacement of these objects, the flaps 14 and 15 are folded down, then from above the assembly the portion 111 is again bent in the direction of the arrows F9 (FIG. 29) and after closure, there is obtained the container of FIG. 30 which, as is seen, has a continuous external protective flange, over all the periphery of the container, thereby sheltering the small lateral surfaces from shocks, in addition to the protection of the corners described with respect to FIGS. 21 to 25.

Referring now to FIGS. 31 to 36, there is seen another embodiment which constitutes a sort of combination of the embodiments of FIGS. 21 to 25 on the one hand and 26 to 30 on the other hand. Thus, in this case the original sheet is of T shape as in FIG. 21, but has an end panel which folds down on the central portion as in FIG. 26. The same elements bear the same reference numerals.

In this case, the central portion 131 is secured to a transverse portion 132 by means of a transverse fold line 133 prolonged by two cutout lines 134 and 135, the portion 132 comprising a central base 136 on opposite sides of which are located the flaps 14 and 15.

The central portion 131 has a length such that it has an intermediate panel 137 having the same dimension as the base 136 measured longitudinally between the fold line 135 and a second fold line 138.

The base 136 has a central tongue 139 which extends beyond the free straight edge 140 of said base 136 and in which are cut out notches 71 and 72 defining the hooks 77 and 78. which are cut out notches 71 and 72 defining the hooks 77 and 78.

The fold line 138 comprises a central slot 141 whose extent is substantially equal to that of the tongue 139.

This embodiment then permits a use analogous to that which has been described with respect to FIGS. 21 to 25.

Figures 31, 32, 33, 34, 35, 36:
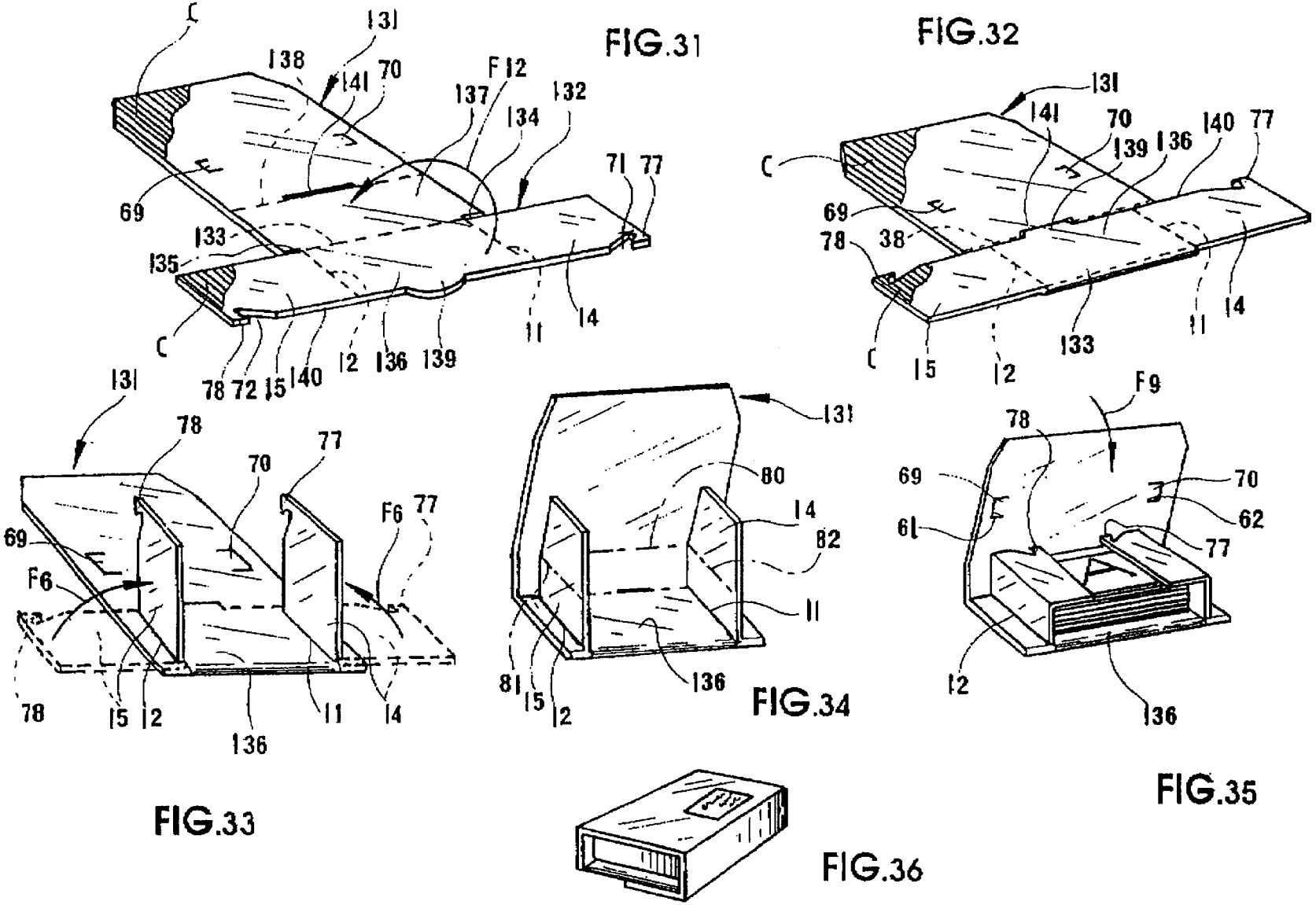
FIGS. 31 to 36 are schematic views which show the application of the holding means in temporary straightened position with a sheet obtained by bending an end unglued flap.
Figure 38:
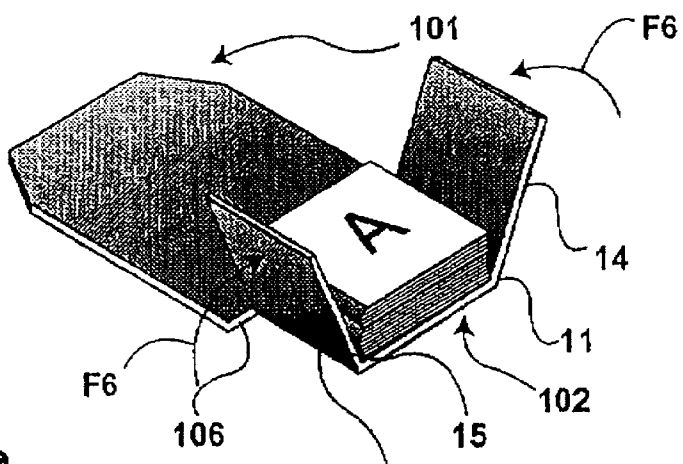
FIGS. 37 to 40 show an embodiment of the invention according to which the container is very simple, and hence inexpensive, whilst ensuring efficacious protection of the eight corners of the parallelepipedal container after closing.

The panel 132 is first folded down over the portion 131 in the direction of arrow F12 in FIG. 31, such that the base 136 is superposed exactly on the intermediate panel 137, then on the one hand the flaps 14 and 15 are straightened which pivot about the fold lines 11 and 12 (arrows F6 in FIG. 33) and on the other hand the portion 131 which pivots about the transverse fold line 138 and the tongue 139 is engaged in the slot 141 such that the base 136 is secured to the intermediate panel 137, which is to say to the central part 131.

The stable relationship shown in FIG. 34 is thus achieved.

The objects to be packaged are then placed on the base 136, which has the double thickness of panel 137 and base 136 and which is therefore particularly strong.

The flaps 14 and 15 are folded down over the objects, then the portion 111 is again bent according to the arrow F9 (FIG. 35) and after closure, there is obtained the container of FIG. 36 which, it will be seen, has a continuous external protective edge, over all the periphery of the container, thereby sheltering the small lateral surfaces from shocks.

Referring now to FIGS. 37 to 40, there is seen a container according to the invention which is particularly simple and inexpensive, whilst ensuring the protection of the eight corners of the completed container.

The corrugated cardboard sheet is cut out in a single piece and is of the same type as that of FIGS. 21 to 25. The same elements bear the same reference numerals.

The sheet is cut out in the general shape of a T and has a central portion 101 secured to a base 102 which is connected to the portion 101 by a fold line 103 at the ends of which are located cutout lines 104 and 105.

The base 102 is secured to the two lateral flaps 14 and 15 by fold lines 11 and 12, which constitute the bar of the T.

The two cutout lines 104 and 105 permit lateral flaps 14 and 15 to be straightened beyond the longitudinal edges of the intermediate panel 101 so as to define, after folding, an external protective return at each of the four corners of each of the two small lateral faces 26 and 27 and an external protective edge over three sides of said small lateral surfaces 26 and 27.

The objects are directly placed on the base 102, then the flaps 14 and 15 are straightened in the direction of the arrows F6, so that they pivot about the fold lines 11 and 12, then the central portion 101 is raised, which pivots about the fold line 103.

Figure 39:
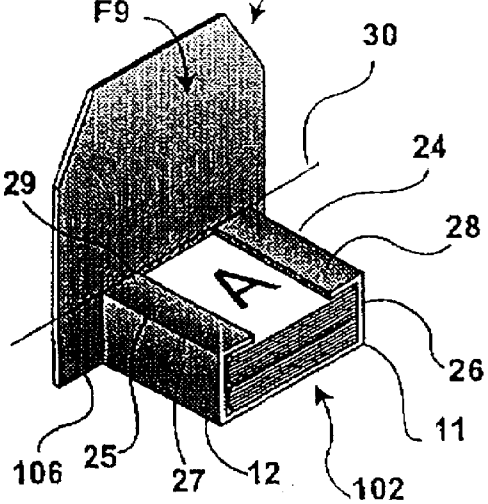
Figure 43:
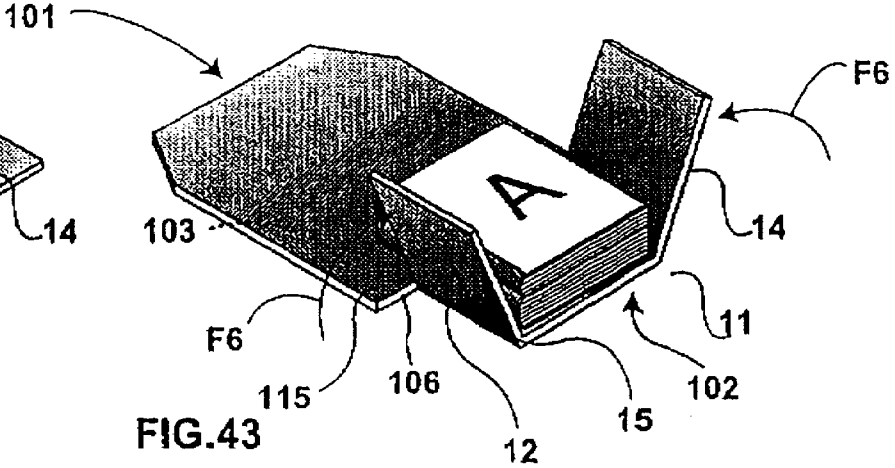
FIGS. 42 to 45 are schematic views of the embodiment of FIGS. 37 to 40, according to a modification which improves the protection of two of the eight corners of the container.

Next, the flaps 14 and 15 are folded down on the packaged objects (FIG. 39). This having been done, they bend transversely to themselves about lines 24 and 25 to form sidewalls 26 and 27 as well as the flaps 28 and 29.

The portion 101 is then folded down over the flaps 28 and 29, in the direction of arrow F9, this portion 101 bending along a transverse line 30 which automatically forms under the influence of the edges of the flaps 28 and 29 which force the cardboard to bend.

The position of the line 30 is at random because it depends on the height of the objects which are located below the flaps 14 and 15, the region of the central portion 101 located between the two transverse lines 103 and 30 constituting a small transverse surface 31 of the container.

The length of the central portion 101 is selected so as to be sufficient to close the container with a maximum height of packaged objects.

After the portion 101 having been applied to the flaps 28 and 29, it is again folded, along the line 32 which automatically forms under the influence of the edges of the flaps 28 and 29, which force the carton to bend, then again along the line 33 so that the end of the portion 101, which constitutes a closure tongue, can be applied and secured below the base 102, the region of the central portion 101 located between the two transverse lines 32 and 33 constituting a second small transverse surface 34 of the container (FIG. 40) opposite the first one 31.

Figure 37:
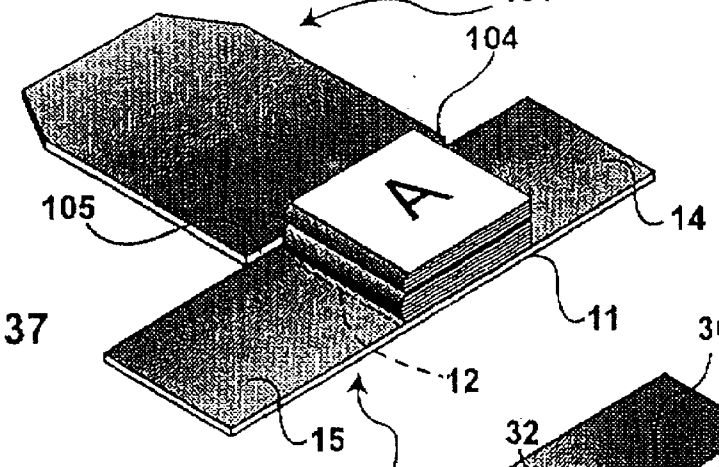

It will be seen in FIG. 37 that the fold lines 11 and 12 lead to the junction point of the fold line 103 and the cutout lines 104 and 105. Because of this, when the lateral flaps 14 and 15 are straightened, they disengage from the edges of the cutout lines, of which only the edge 106 is visible on the drawing, the other being symmetric to the latter and being hidden in the drawing.

Thanks to this voluntary offset, the longitudinal edges of the portion 101 extend beyond the small lateral surfaces 26 and 27 and constitute external protective edges.

Figure 40:
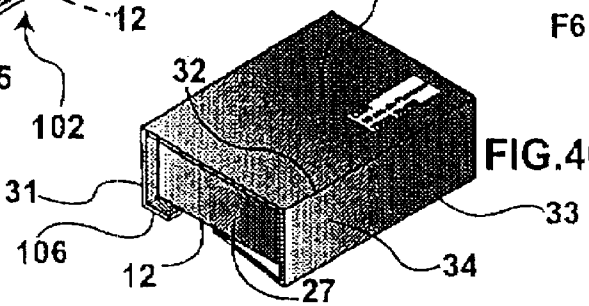

However, in this case, such an edge does not exist at the level of the base 102, as is seen in FIG. 40. It could exist only if the height of the objects were the minimum, the return below the base 102 of the central portion 101 being prolonged over all the depth of the base 102.

It will nevertheless be noted that the four corners of each small lateral surface (namely eight corners in total for the whole container) are each protected by a return of the cardboard, which is believed to suffice in many cases.

Figure 41:
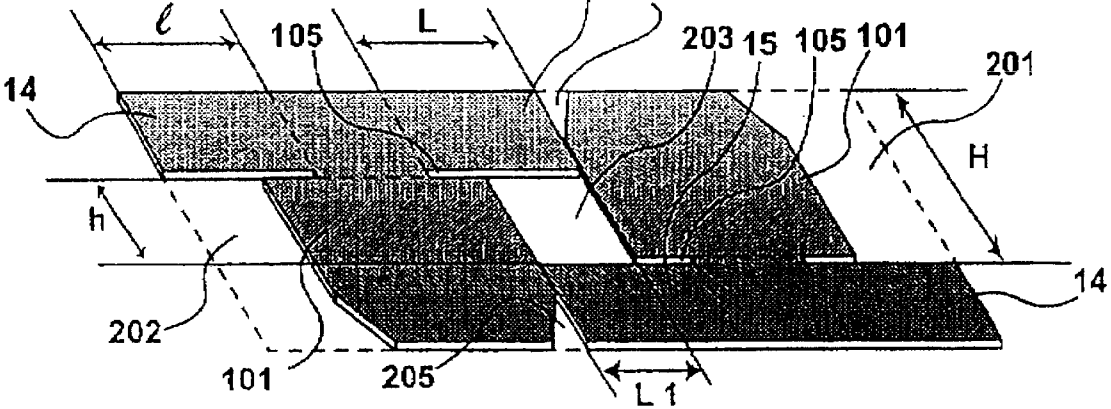
FIG. 41 is a schematic view showing an embodiment of the invention according to which overlapping of the sheets during their cutting gives rise to only a small quantity of waste.

FIG. 41 shows a modification of the invention according to which the two flaps 14 and 15 are unequal, the flap 14 being shorter and the flap 15 longer, the total remaining unchanged, as in FIGS. 37 to 40.

This arrangement permits a superposition of at least two sheets, during their simultaneous cutting out from one cardboard carton plate, which is more favorable than with flaps 14 and 15 being equal.

Thus, it will be noted that the portions line of points represent scraps of cardboard to be eliminated and it will be seen that the external scraps 201 and 202 extend over all the height H of the portion 101 and over the width 1 of the flaps 14 which is less than the width L of the flaps 15. The surface Si of each of these scraps is equal to:

$$L \times 1 = S1$$

and the total of two:

$$S1 \times 2 = 2S1$$

The interior scrap 203 extends between the two flaps located facing two adjacent sheets along a height h substantially less than the height H of the portion 101 and along a width L1 less than the width L of a distance equal to twice the depth of a cutout line 105. Its surface S2 is equal to:

$$S2 = h \times L1.$$

The small scraps 204 and 205 are less significant because they correspond only to the oblique cutout of the closure tongue.

Computation shows that the total surface of the scraps, namely 2 S1+S2 (neglecting the scraps 204 and 205) is less by 41% than that of the scraps of an identical cutout (with the same dimensions) of a container having two flaps 14 and 15 that are equal, because if that decreases a bit the small surface S2, this greatly increases the large surface S1.

Referring now to FIGS. 42 to 45, there is seen a particular embodiment of the invention, in which the four corners of each small lateral surface of the container are reinforced, which, according to FIGS. 37 to 40, is limited by the edge 106. To do this, the cutout lines 104 and 105 are provided beyond the fold line 103, which has the result that the flaps 14 and 15 are more narrow than the base 102. There are thus defined two tongues 115 (of which only one is seen in the drawing) located between the fold line 103 and the edge 106.

Figure 45:
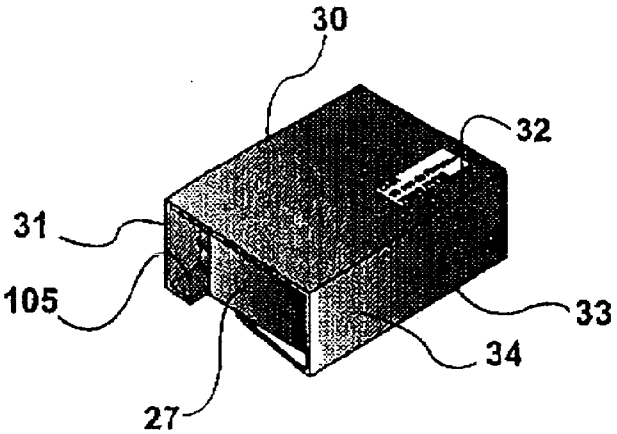
Figure 42:
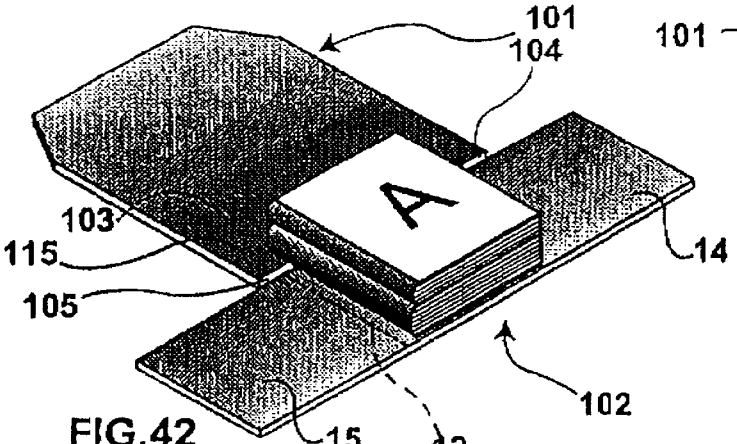
Figure 44:
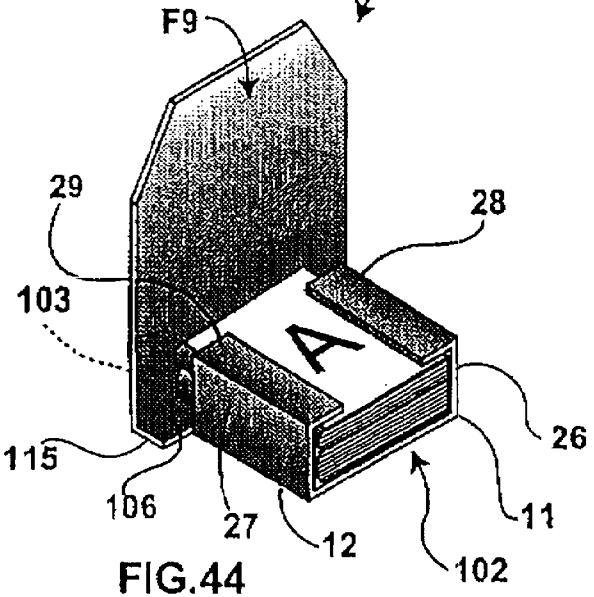

In FIGS. 44 and 45, it is clearly seen that after straightening the portion 101, the tongues 115 remain in the same plane as the base 102 and thus constitute a portion of the external protective edge.

In counterpart to this advantage, it will be seen that there remains a passage between the exterior of the container and the interior, against the cut edge of the corresponding flap 14, 15, which could give access to the packaged objects, as is shown in FIG. 45.

This embodiment is nevertheless applicable to numerous types of packaging, when the objects are more narrow than the base, which is to say when their width is less than or substantially equal to that of the flaps and, as a result, they do not face the passage.

What is claimed is:

1. A container for packaging solid objects, said container being formed from a cutout sheet that is foldable from a first position to a second position to define said container, said container comprising:

a base for receiving the objects;

a pair of lateral flaps connected to the base, said lateral flaps are foldable down over the objects disposed on the base; and a closure tongue connected to the base and foldable over the lateral flaps, said sheet being a flat blank comprising two parallel rectangular portions each having two transverse end edges and two longitudinal edges, said two rectangular portions are connected to each other by a truncated triangular tongue having a first side being cut, a second side and a base of the truncated triangular tongue are each formed by a fold line, the fold line of the base being at a first one of each of the two longitudinal edges, common to the two rectangular portions, said common longitudinal edge being shorter than a length of the two rectangular portions, the first rectangular portion having an end panel connected to the truncated triangular tongue, the truncated triangular tongue being defined in a contour of a second of the two rectangular portions, said second rectangular portion having a length such that the two transverse end edges of the second rectangular portion are substantially offset relative to the two transverse edges of the first rectangular portion, in the first position, the second rectangular portion is folded flat against the end panel to extend transversely to the first rectangular portion, in the second position, the base of the container being formed by superposing a central region of the second rectangular portion and the end panel of the first rectangular portion, and the end panel of the first rectangular portion and the central region of the second rectangular portion having means for securing to each other, in said second position.

2. The container according to claim 1, wherein the means for securing comprise at least one tongue in at least one of a contour of the end panel and in the central region of the second portion and an opening in at least one of the contour of the central region of the second rectangular portion and the end panel of the first rectangular portion.

3. The container according to claim 1, wherein the first rectangular portion has a length sufficient to have an intermediate panel between the base of the container and the closure tongue said intermediate panel having an area that is substantially equal to an area of the base of the container, an assembly formed by the base of the container, the objects and the lateral flaps, in said second position is foldable over the intermediate panel by pivoting the assembly by 180° to a third position, the assembly is maintained in the third position temporarily by a weight of the objects.

4. A container formed from a cutout sheet is foldable from a first position to a second position to define said container, said container comprising:

a base for reception of objects, a pair of lateral flaps extending outwards of said base that are foldable down from above over the objects disposed on the base, a closure tongue connected to said base, and an intermediate surface panel between said base and said closure tongue, wherein said lateral flaps are folded parallel to one another after partial folding of the sheet, said lateral flaps being perpendicular to the base such that access to the base will be free for emplacement of the objects on the base, in said second position, and wherein said lateral flaps have means for securing to said intermediate surface panel, such that the lateral flaps and the intermediate surface panel are temporarily secured together in the second position after partial folding, before emplacement of the objects on the base and until closure of the container.

5. The container according to claim 4, wherein the temporary securing means comprise openings in an interior of a contour of the intermediate panel and a tongue defined by material of a flap that remains after cutting out a notch in one edge of each of the lateral flaps, each said tongue facing the opening of the intermediate panel when said lateral flaps and said intermediate panel are in the second position, such that said tongues can be engaged in said openings by inclination of the intermediate panel toward the lateral flaps.

6. The container according to claim 5, wherein the lateral flaps are folded along lines located beyond edges of the base so as to define external protective edges in said second position.

7. The container according to claim 5, wherein each notch is oblique relative to the edge of a respective lateral flap with respect to an angle substantially equal to that of an inclination of the intermediate flap when the tongues are engaged in the openings.

8. The container according to claim 5, wherein each notch has a hook shape at a free end of each respective tongue.

9. The container according to claim 5, wherein each of the openings of the intermediate panel is formed by a plurality of incisions which leave a tongue belonging to the intermediate panel along a virtual line parallel to a plane in which the tongues are located when they are engaged in the openings.

10. The container according to claim 5, wherein the sheet comprises a rectangular strip of corrugated cardboard, a plurality of flutes of the corrugated cardboard are disposed longitudinally or transversely relative to the larger dimension of the rectangular strip, according to the orientation of the openings and of the tongues, such that said flutes are perpendicular to the edges of the flaps in which the notches are cut out.

11. The container according to claim 4, wherein the base of the container is formed by superposing two panels against each other by folding, and the container has means for connecting the two panels to each other after folding and superposition.

12. The container according to claim 11, wherein one of the two panels is an end panel between said lateral flaps having a free transverse edge and the other of the two panels is the base, said end panel and said base being secured to each other by folding the end panel along a first transverse fold line onto the base, and the means for connecting comprises a tongue extending beyond a free edge of said end panel and a slot in a second transverse fold line opposite the free edge and along which the base is secured to the intermediate panel.

13. The container according to claim 11, wherein one of the two panels is an end panel between the lateral flaps having a free transverse edge and the other of the two panels is the base, said end panel and said base are secured to each other along at least one transverse fold line by folding the end panel against the base, and the means for connecting comprise lateral strips of the end flap glued to said base.

14. The container according to claim 4, wherein the sheet has a general T shape, the two lateral flaps are located on opposite sides of the base, said base is secured to the intermediate panel at a transverse fold line, at ends of the transverse fold line are two cutout lines permitting the two lateral flaps to be straightened beyond the longitudinal edges of the intermediate panel so as to define, after folding into said second position, two small lateral surfaces, and an external protective return at each of four corners of each of the two small lateral surfaces and an external protective edge on three sides of said two small lateral surfaces.

15. The container according to claim 14, wherein the transverse fold line is located beyond the cutout lines so as to define tongues that are to rest in a same plane as the base in said second position, said lateral flaps having a width less than that of said base.

* * * * *